United States Patent [19]

Stewart

[11] 4,077,160

[45] Mar. 7, 1978

[54] SCREEN DOOR CONSTRUCTION

[75] Inventor: David E. Stewart, Los Angeles, Calif.

[73] Assignee: Empire Metal Products Corporation, Los Angeles, Calif.

[21] Appl. No.: 751,030

[22] Filed: Dec. 16, 1976

[51] Int. Cl.[2] ..... E05D 13/00

[52] U.S. Cl. ..... 49/421; 16/105; 160/381

[58] Field of Search ..... 49/421, 417, 414, 404, 49/427, 425, 428, 420, 452, 454; 160/376, 369, 375, 381; 16/105

[56] References Cited

U.S. PATENT DOCUMENTS

| | | | |
|---|---|---|---|
| 1,258,432 | 3/1918 | Myers | 49/420 X |
| 1,737,944 | 12/1929 | Pollack | 49/421 |
| 2,677,154 | 5/1954 | Agle | 49/425 |
| 3,241,283 | 3/1966 | Ahlgren | 49/425 |
| 3,302,351 | 2/1967 | Trulaske | 160/381 X |
| 3,619,947 | 11/1971 | Burum | 49/425 |

*Primary Examiner*—Philip C. Kannan
*Attorney, Agent, or Firm*—Keith D. Beecher

[57] ABSTRACT

A screen door is provided having a spring-loaded adjustable bonnet on the top side or bottom side thereof, or both, and which includes two adjustment means which permit the bonnet to be set at any desired displacement from the top side or bottom side of the door to fit the door to a variety of doorway heights. Each adjustment means includes a serrated corner lock member which fits into the door frame and which serves firmly to lock the adjacent corner of the door frame, the corner lock member including an integral bushing which fits between two aligned holes in the door frame. Each adjustment means also includes an internally-threaded, headed sleeve which extends through one of the holes from one side of the door into the bushing, and an externally-threaded bolt which extends through the other hole from the other side of the door into the bushing, the bolt being threaded into the sleeve. The bonnet fits over the door frame in sliding telescopic relationship therewith, and it has aligned slots which receive the sleeve and bolt. A resilient arcuately-shaped spring strip is fitted between the bonnet and the frame. The bonnet is moved against the spring bias of the strip to a desired displacement with respect to the frame, and the bolt is then tightened into the sleeve. When the bolt is tightened, the bonnet, bushing and frame are all locked together, and there is no tendency for the bonnet to slip, or for the corners of the door frame to pull apart.

4 Claims, 6 Drawing Figures

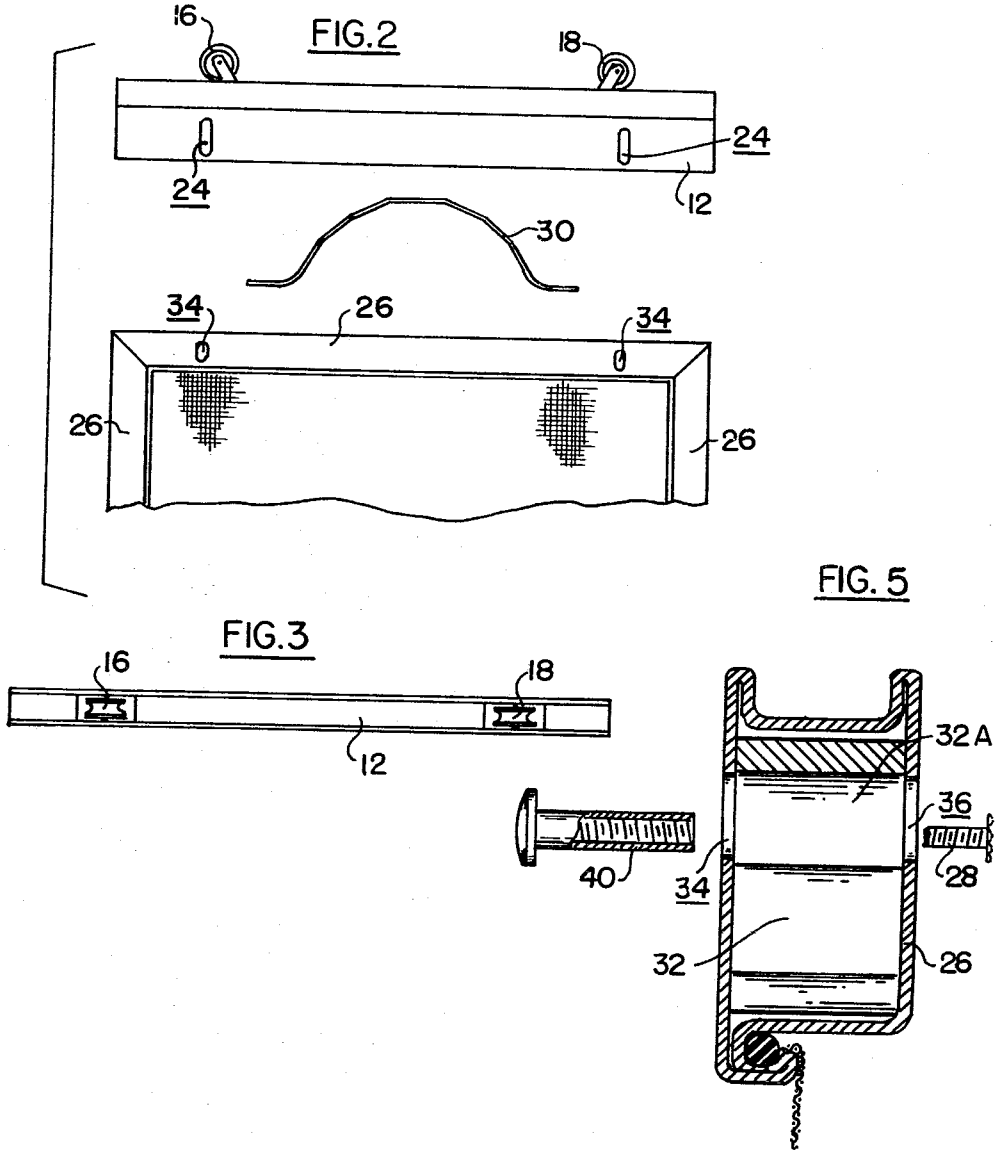
FIG. 2
FIG. 3
FIG. 5
12
16
18
24
26
30
34
32A
36
28
32
40
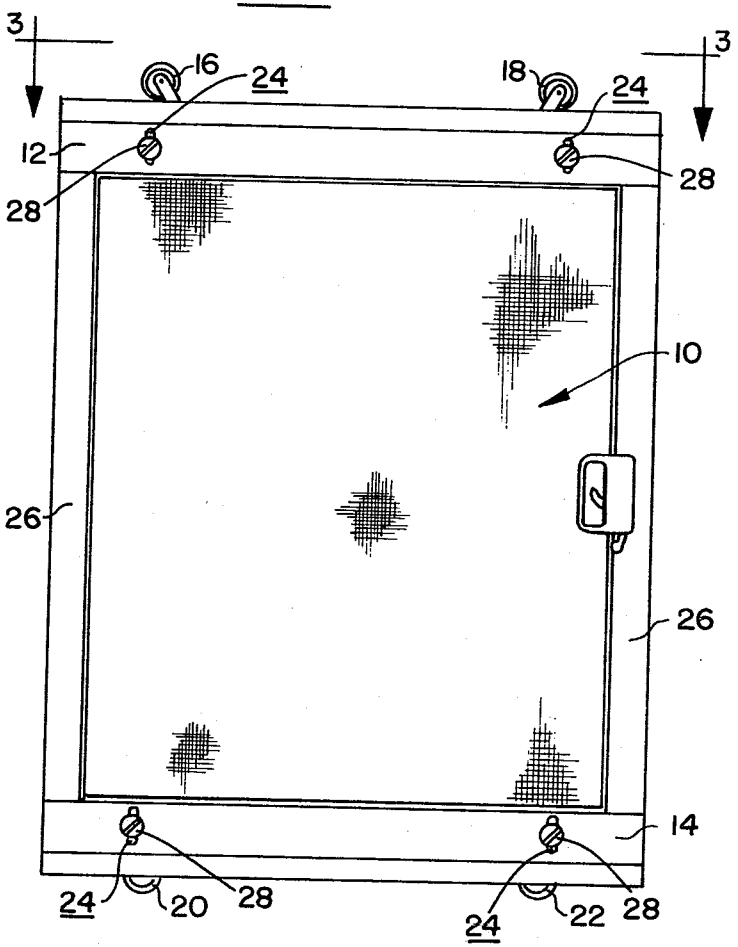
FIG. 1
3
10
12
14
16
18
20
22
24
26
28

SCREEN DOOR CONSTRUCTION

BACKGROUND OF THE INVENTION

The screen door of the invention in its preferred embodiment is of the sliding type, and it is equipped with rollers mounted in channels in the upper and lower edges of respective bonnets which are fitted over the top and bottom of the frame of the door. The rollers are received on rails which are fitted at the top and bottom of the doorway in which the door is to be installed.

Since the doorways do not have standard heights, it is usual in the prior art to provide the aforesaid bonnets at the top or bottom, or both, of the door frame, the bonnets being set to a desired displacement with respect to the frame, so that the rollers will fit exactly on the upper and lower rails. However, difficulties have been encountered in the prior art in providing a suitable means for locking the bonnets in a non-slipping relationship with the door frame after they have been set.

The present invention provides a simple and inexpensive assembly which can be loosened to permit the bonnets to be moved in or out to a desired displacement with respect to the door frame, and which may then be tightened to lock the bonnets to the frame without any tendency for the bonnets to slip, and which also serves to lock the corners of the door frame firmly together.

As explained above, the assembly comprises a serrated corner lock member which is fitted in a friction fit within the door frame at the adjacent corner of the door frame to hold the door frame together. The corner lock member includes an integral bushing which fits in the door frame between aligned holes. The assembly also includes a sex bolt (which comprises a headed sleeve with internal threads and an externally threaded bolt) which is received in the sleeve. Each bonnet has slots at each end which receive the sex bolt, and which permit the bonnet to be moved in or out with respect to the door frame. When the sex bolt is tightened, the corner lock member, the door, frame and the bonnet all lock together in a non-slipping relationship.

BRIEF DESCRIPTION OF THE DRAWING

FIG. 1 is a elevational view of a screen door which may be constructed to incorporate the concepts of the present invention;

FIG. 2 is a detached elevational representation of certain components of the door of FIG. 1, including a bonnet which is fitted across the top of the door frame;

FIG. 3 is a top view of the door of FIG. 1 taken essentally along the line 3—3 of FIG. 1;

FIG. 5 is a section taken along the line 5—5 of FIG. 4; and

DETAILED DESCRIPTION OF THE ILLUSTRATED EMBODIMENT

Figure 4:
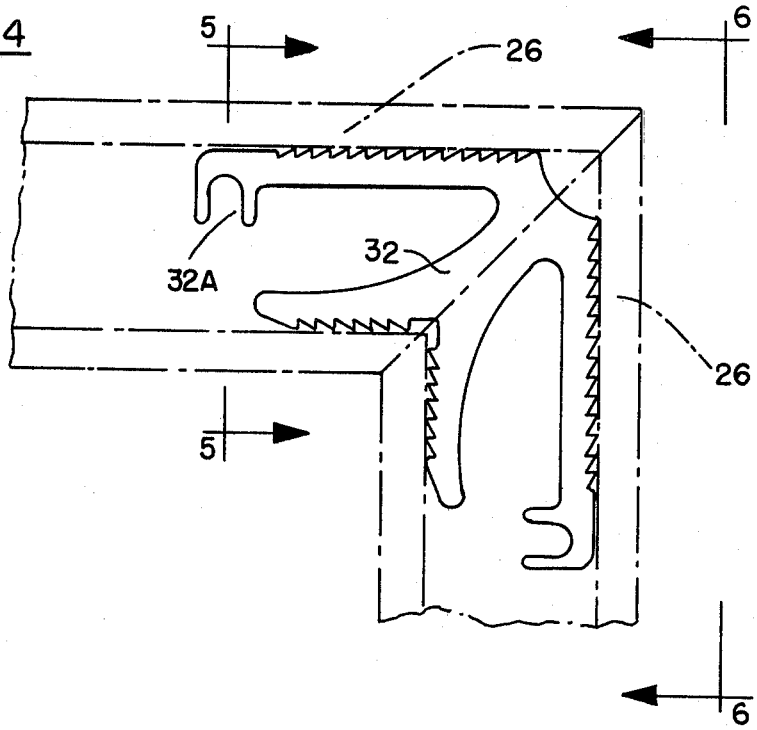
FIG. 4 is an enlarged detail of one corner of the door frame of FIG. 1 with the bonnet removed and showing an internal corner lock member which serves to hold the corner together.

The illustrated assembly comprises a screen door 10 which is equipped with a bonnet 12 at its top side, and with a bonnet 14 at its bottom side. A pair of rollers 16 and 18 are mounted in the upper edge of bonnet 12, and a pair of rollers 20 and 22 are mounted in the lower edge of bonnet 14. The rollers are received on upper and lower rails in the doorway in which the door is installed. The rollers 16 and 18, for example, may be of the spring-loaded type such as described and claimed in Copending Application Ser. No. 720,888 filed Sept. 7, 1976 in the name of the present inventor.

The bonnets 12 and 14 are equipped with vertical extending slots, such as slots 24, which permit each bonnet to be moved in and out to any desired displacement with respect to the frame 26 of the door. The bonnets are then locked at a desired displacement by bolts, such as bolt 28.

As shown in FIG. 2, an arcuately-shaped spring strip 30 is interposed between the door frame 26 and the bonnet 12, so that the bonnet may be spring-biased away from the frame. A similar spring is interposed in the bottom of the door between the frame and bonnet 14.

Figure 6:
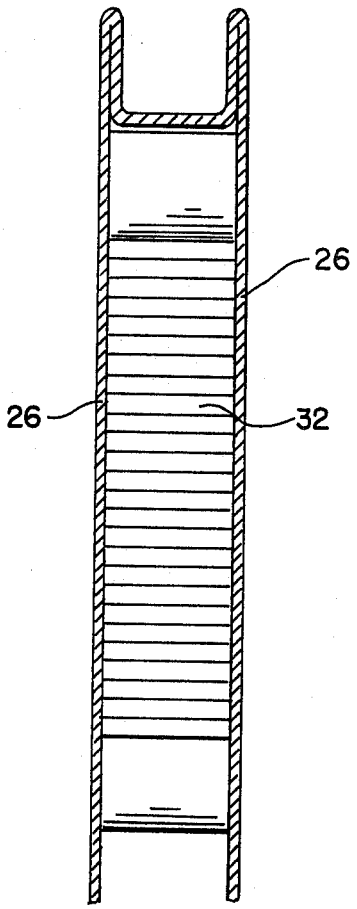
FIG. 6 is a section taken along the line 6—6 of FIG. 4.

As best shown in FIGS. 4 and 6, the door frame 26 forms an internal channel, and a serrated solid corner lock member 32 is interposed in the channel in a friction fit with the sides thereof to hold the adjacent corner of the door frame together. The corner lock member 32 includes an integral bushing 32A which fits between a pair of aligned holes 34 and 36 in the door frame. The bolt 28 is received through slot 24 on one side of bonnet 12, and through hole 36 into the interior of bushing 32A. A headed internally threaded sleeve 40 is received through a similar slot 24 on the other side of the bonnet, and through a hole 36 on the other side of frame 26 into the other end of bushing 32A.

When the bolt 28 and sleeve 40 are loosened, the spring 30 biases the bonnet 12 outwardly, and the bonnet can be set to any desired displacement with respect to frame 26. When the bolt 28 is tightened into sleeve 40, it serves to lock the frame 26, the corner lock member 32 and the bonnet 12 together, in a non-slipping relationship.

A similar assembly to that described above is provided at each corner of the door.

The invention provides, therefore, a simple and inexpensive means for coupling a spring-loaded bonnet to the frame of a door, and which, when tightened, securely locks the bonnet to the frame without any tendency for the bonnet to slip.

While a particular embodiment of the invention has been shown and described, modifications may be made. It is intended in the claims to cover the modifications which come within th spirit and scope of the invention.

What is claimed is:

1. In combination with a screen door, and the like, having a hollow frame defining a channel, and a bonnet fitted over the frame in sliding telescoping relationship therewith, said frame having two aligned holes therein adjacent at least one corner thereof, and said bonnet having two aligned slots therein also aligned with the holes; a corner lock member fitted in friction fit in the channel of the frame to hold the adjacent corner together, said corner lock member including an integral bushing fitted between the aligned holes in the frame; a headed internally-threaded sleeve extending through one of the slots in the bonnet and through one of the holes on one side of the frame into the bushing; and an externally threaded bolt extending through the other one of the slots in the bonnet and through the other one of the holes on the other side of the frame into the bushing to be threadably received in the sleeve, the bolt and sleeve locking the bonnet, corner lock member and frame together when the bolt is tightened into the sleeve.

2. The combination defined in claim 1, and which includes an arcuately-shaped resilient member interposed between the frame and the bonnet to exert a spring load on the bonnet biasing the bonnet in a direction away from the frame.

3. The combination defined in claim 1, in which the door is a sliding type, and which includes rollers mounted in the edge of the bonnet remote from the frame.

4. The combination defined in claim 1, in which said corner lock member is a solid member having serrated edges engaging the inner walls of said frame.

* * * * *